United States Patent [19]

Ragsdale

[11] 4,238,065

[45] Dec. 9, 1980

[54] FILM MATERIAL DISPENSER

[75] Inventor: Donald W. Ragsdale, Creve Coeur, Mo.

[73] Assignee: Cavalier Products, Inc., St. Louis, Mo.

[21] Appl. No.: 952,694

[22] Filed: Oct. 19, 1978

[51] Int. Cl.[3] ..... B26F 3/02

[52] U.S. Cl. ..... 225/47; 225/48; 206/409; 229/17S

[58] Field of Search ..... 225/48–50, 225/47; 229/17S; 206/58

[56] References Cited

U.S. PATENT DOCUMENTS

| | | | |
|---|---|---|---|
| 3,144,970 | 8/1964 | Beschmann | 225/49 X |
| 3,477,624 | 11/1969 | Branyon et al. | 225/48 X |
| 3,698,548 | 10/1972 | Stenzel et al. | 225/48 X |

*Primary Examiner*—Frank T. Yost
*Attorney, Agent, or Firm*—Paul M. Denk

[57] ABSTRACT

In a film material dispenser, generally formed from paperboard, and formed having front, back and bottom panels that are foldably connected together, a top panel also foldably connected to the back panel, and is capable of being opened or closed as desired; a slot is provided through the top panel for dispensing of the leading edge of the film material therethrough, and a front flap, foldable in half, and having a cutting edge provided at its forwardmost edge, is insertable contiguously against the inner surface of the front panel, while one of the front flap folded parts extends the cutting edge upwardly for use in severing of the film material during dispensing. Side walls comprising a series of folding flaps are provided laterally of the carton and are folded into adjacency for aligningly disposing their apertures into which the roll ends of the film material are located, while additional flaps are folded over so as to dispose bearing surfaces upon which the roll ends may be stabilized and supported during the dispenser usage.

6 Claims, 6 Drawing Figures

FILM MATERIAL DISPENSER

BACKGROUND OF THE INVENTION

This invention relates generally to a film dispenser, and more particularly pertains to a dispenser having means for fully stabilizing the roll of film material therein, while also conveniently disposing cutting means for precision severing of the film material during its dispensing.

Numerous styles of dispensing boxes are available in the prior art. Many of these dispensers have been designed primarily for providing protection to the film or paper material contained therein, but provides little structural support and stability for the film roll during its locating within the box, and generally do not provide conveniently positioned means for cutting of its roll material. Examples of the known prior art include the United States patent to Feinberg, U.S. Pat. No. 2,330,117, wherein the dispensing box contains the usual folding side flaps that interlock to provide closure at this location for the box. The patent to Branyon, et al, U.S. Pat. No. 3,477,624, discloses a dispensing carton for holding roll material, and which dispenses its roll material through the front panel of the carton. One of the problems in the use of this shown carton is that dispensing the sheet material through the front panel does not conveniently dispose it with respect to its cutting edge so that the sheet material can be easily severed during usage.

The U.S. Pat. No. 3,698,548, to Stenzel, discloses a box for dispensing flexible sheet material wherein the side support for the roll of material is formed having semicircular slots for supporting the roll at this location. The U.S. Pat. No. 2,474,783, to Gluck, discloses another variation upon a carton for holding roll material. And, U.S. Pat. No. 3,552,614, to Wilson, shows a variation upon a cutter, and its guard, for a sheet material cutter.

In view of the foregoing, it is the principal object of this invention to provide a uniquely structured film dispenser that provides full stability in the support of the roll ends through the folding of various designed side flaps into the configuration of the side walls for the same carton.

Another object of this invention is to provide means for stabilizing the ends of a roll of film material within a carton, through a combination of positioning and supporting flaps that both suspend the roll at the approximate aligned center of the carton, while at the same time furnishing full undersupport through the agency of a journal like formation formed of one of the flaps at each side wall for the carton.

Another object of this invention is the provision of various interlocking means provided adjacent each of the formed side walls of a film dispenser so as to insure retention and the integrity of the side wall after its formation within the folded carton.

Still another object of this invention is to provide a uniquely formed cutter means conveniently disposed, as during usage, slightly elevated above the top panel of the carton, but yet said cutting means being adhered upon a front flap that can also be slid into concealment and unexposed within the carton as during its nonusage.

Another object of this invention is to provide convenient structure for insuring the proper disposition of the cutter slightly above the top panel of the carton as during film dispensing.

These and other objects will become more apparent to those skilled in the art upon reviewing the summary of this invention, and upon undertaking a study of the description of the preferred embodiment of the invention in view of its drawings.

SUMMARY OF THE INVENTION

This invention contemplates the formation of a film material dispenser, formed into a carton, and generally fabricated from a unitary sheet of paperboard material, after it is cut and scored into the blank form. The film dispenser includes the usual front, back, and bottom panels that are foldably connected together into the carton configuration, and contains side walls that are uniquely fabricated from various flaps that cooperate not only to furnish closure at the lateral positions of the carton, but in addition, provide the means for stabilizing the roll ends during the carton's support of a roll of heavy film, as during usage. Furthermore, a top panel for the carton incorporates a slot, and through which the leading edge of the film material may be withdrawn from the same, with a cutting means connecting with the frontal edge of the top panel conveniently disposing its cutter slightly above and to the front of the top surface of the carton so as to furnish a ready severing of the film material as it is being withdrawn from the same. This cutting means is mounted onto a doubly folded front flap, which a previously described, foldably connects with the frontal edge of the top panel, with the front flap being folded longitudinally into two components, so that its cutter may be disposed upwardly as during usage, but that said front flap may be unfolded as during nonusage and tucked contiguously against the inner surface of the frontal panel for the carton.

The side walls for the film dispensing carton of this invention incorporate a series of flaps, as previously explained, which are generally designed for providing enclosure to the lateral segments of the carton, but in addition, to provide a means for furnishing a reinforced support for the positioning of the roll ends of the film material within the carton so that the material will be conveniently dispensed from the same without any binding of the roll therein. These flaps include a first apertured flap foldably connected with the front panel of the container, and which is bent at a perpendicular angle so as to be disposed across the open end of the carton during its formation. A second flap connects with the back panel of the container, and when the carton is fully formed, this flap provides the exterior and outside wall for the side wall of the container, at each end. A pair of positioning flaps are connected at one side with this aforementioned flap that connects with the back panel of the carton, and these pair of positioning flaps each have an aperture provided therein, with a slot aligned with one of the apertures, and this design, when folded over into adjacency, furnishes a means for guiding the insertion of the roll ends into the carton, and their locating within the aligned apertures of these pair of positioning flaps, so as to rigidly retain the roll of material positioned rotatably centrally within the said carton. Connected with the opposite side of this second flap is another or supporting flap, which has an aperture provided centrally therethrough, but which flap is capable of folding at approximately its midpoint, as in half, and positioned inwardmost within the carton so as to furnish a form of journaled double under support also for the ends of the film roll. Various locking tabs interengage within select slots provided either through the bottom panel or at other locations formed of each flap configured side wall, so that these various tabs may become aligned within said slots and furnish means for securing the side wall into its folded configuration after carton formation so as to insure side wall integrity for both supporting and positioning the film roll during usage of the carton.

DESCRIPTION OF THE PREFERRED EMBODIMENT

Figure 1:
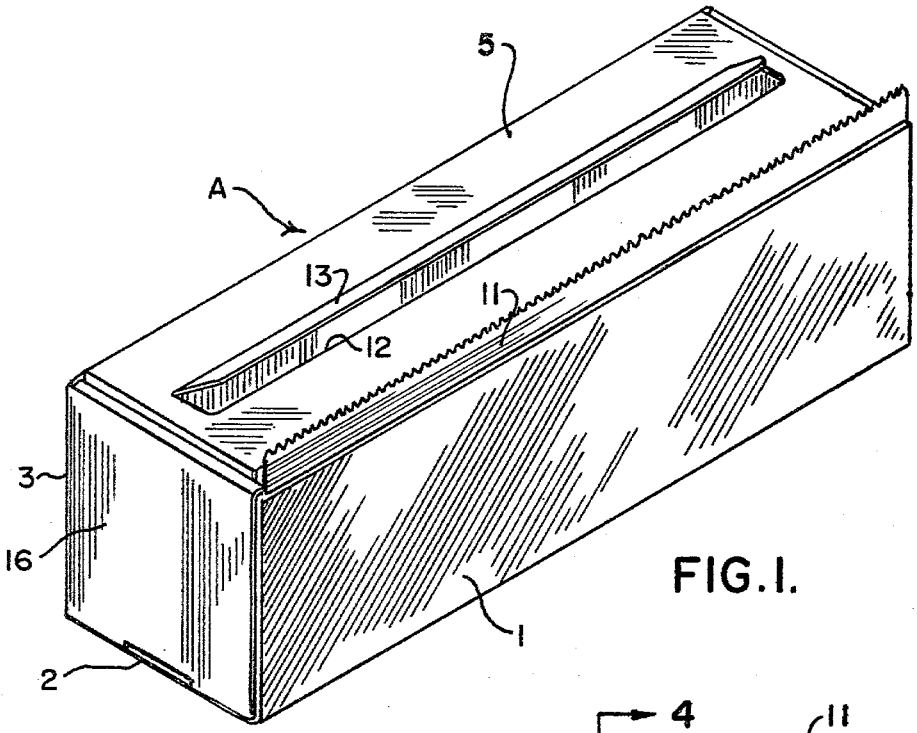
FIG. 1 provides an isometric view of the film dispensing carton of this invention.
Figure 5:
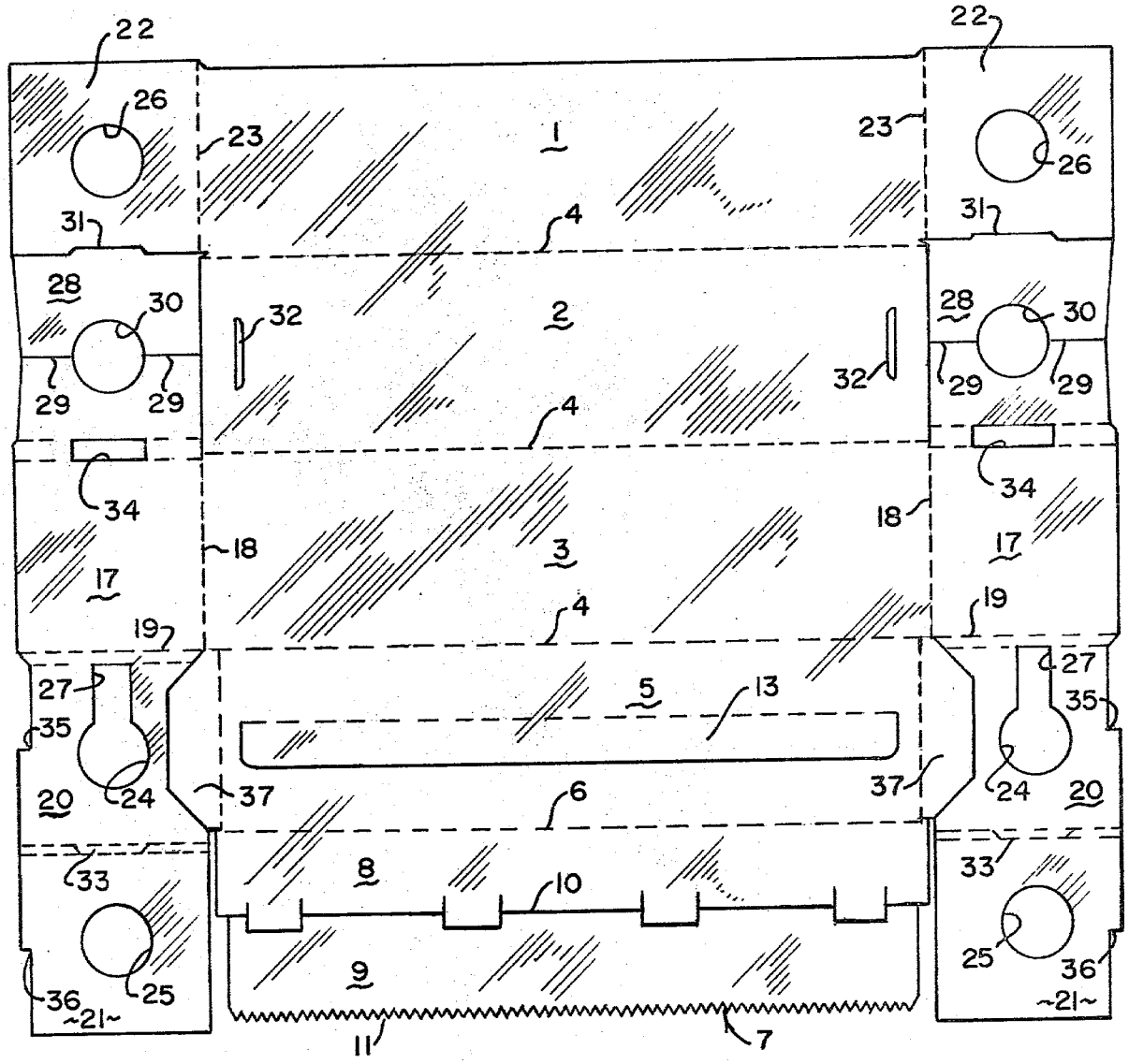
FIG. 5 provides a plan view of the carton blank for use in forming the film dispenser of this invention as shown in FIG. 1.

Referring now to the drawings, and in particular FIG. 1, there is shown the film dispenser A, of this invention. This dispenser is formed from paperboard or other material that may be folded from the blank form, such as shown in FIG. 5, into the configuration of the dispenser as shown, and includes a front panel 1, bottom panel 2, and back panel 3, each of which are foldably connected together along fold lines, as at 4, and which can be folded into the tubular form in the shape of the carton as shown. The top panel 5 is also foldably connected along one of the fold lines 4, for providing closure to the top of the carton as during usage. Foldably connected along the fold line 6 is a frontal flap 7, which is configured into two parts, as at 8 and 9, being held together by means of a score line 10 so that these two components 8 and 9 may be folded over against each other, so as to dispose their attached cutter, as at 11, upwardly of the container, as during usage, as shown in FIG. 1. In this position, the cutter is conveniently disposed just forwardly of that location of the slot 12 provided through the top panel 5 and thorugh which the leading edge of the film material is withdrawn from the carton during its dispensing. The slot 12 approximates the length of the cutter 11, so that both are of convenient width exceeding that of the film rolled therein so as to insure both convenient dispensing and its cutting during usage of the materials dispensing carton. As can be seen, a closure member 13 foldably connects to one edge of the slot formed within the top panel of the carton, and this closure member may be folded downwardly into alignment with the top panel to furnish closure thereat as when the carton is not in use.

Figure 2:
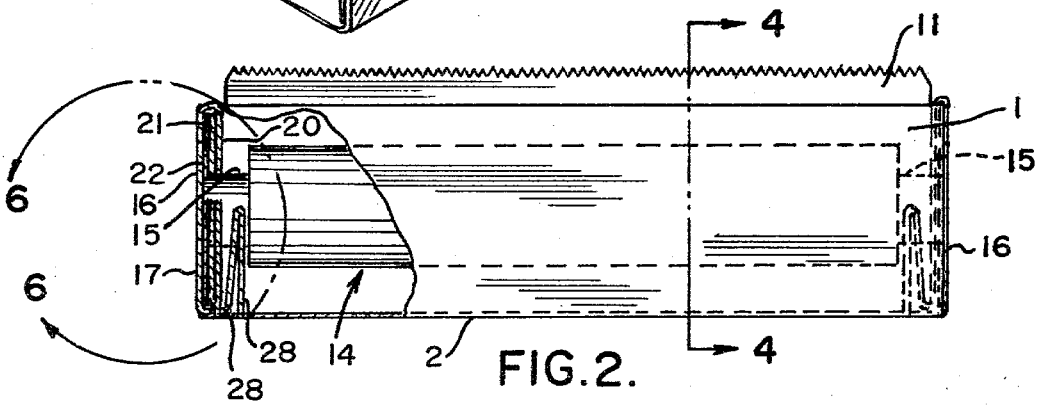
FIG. 2 furnishes a front elevational view of the carton of FIG. 1, with a portion cut away to disclose the mounting, at one end, of the film roll by the configured side wall of the carton.
Figure 3:
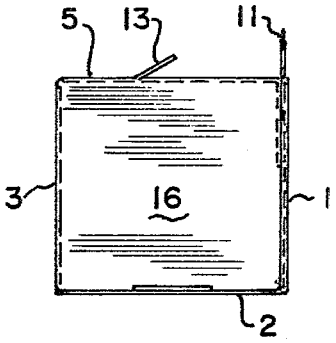
FIG. 3 furnishes a left side view of the carton of FIG. 1.

As can be seen in FIG. 2, the roll 14 of film material is disposed from side to side within the formed carton, and the roll contains extending ends, as at 15, on its core, so as to provide means about which the side walls 16 may embrace for providing a central support for the roll of material within the carton. Since a roll of polyethylene or other types of materials are of substantial weight, it has been found desirable within the design of this invention to provide not only means for positioning the roll centrally and longitudinally within the carton, but to also provide lower support by means of journaling of the roll ends with adequate structure constructed into the side walls of this carton. As can be seen also from the blank of FIG. 5, and also from FIG. 6, the side walls are formed from a series of flaps that are interconnected and folded together to furnish the type of side wall closure and support as shown at this exposed end of the carton in FIG. 2. A first flap 17 foldably connects along fold line 18 with the back wall 3 of the carton. When each of these flaps 17 are folded over into perpendicularity with the back wall 3, and the back wall 3 is folded upright with respect to the bottom wall 2, this flap 17 forms the outermost wall of the side wall 16 of the container. Extending from one side edge, as at 19, of the first flap 17, are a pair of positioning flaps 20 and 21, which are also folded over in the manner as shown in FIG. 2, so as to extend substantially vertically within the formation of the said side wall. A second flap 22 is foldably connected along the fold line 23, and this flap, when folded into perpendicular arrangement with the front panel 1, and when said front panel 1 is arranged upright with respect to the bottom panel 2, this flap 22 becomes arranged intermediate the first flap 17, and the inwardly disposed but upright positioning flap 21. It is to be noted that these flaps 20, 21 and 22 each respectively contain an aperture 24, 25, and 26, so as to provide a series of aligned apertures within each side wall of the container for providing a location for insertion of the roll ends 15 therein for support. To facilitate the sliding insertion of the roll ends 15 into the said aligned apertures, the innermost positioning flap 20, with its aperture 24, has a vertically arranged slot 27, which is useful for providing a guidance and clearance for the insertion of the remaining end of the roll 15 into its aligned apertures, after its other end has already been previously inserted within the series of aligned apertures located to the other side of the carton.

Figure 6:
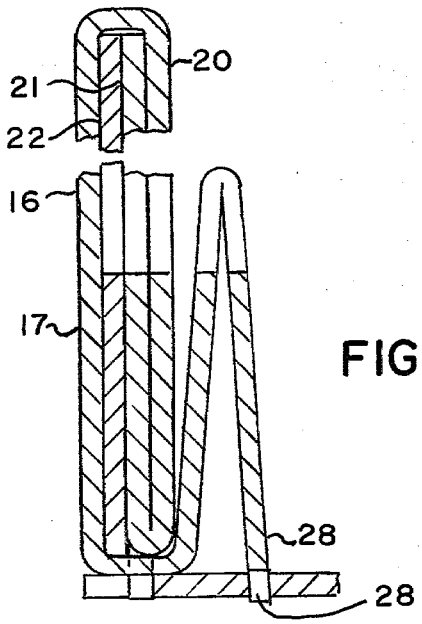
FIG. 6 provides an enlarged view of a flap formed side wall generally as shown in FIG. 2.

To insure the adequate support for the heavy roll of film material within the carton, regardless whether it be during usage or nonusage, a supporting flap 28 is provided also within the formation of each side wall. The supporting flaps 28 are folded over at approximately their midpoint, as along their fold lines 29, and thereby form their apertures 30 into semi-circular positions exposed beneath the film roll to furnish a journaled support to the underside of the same, at each end. Thus, when the side walls are folded into the position as shown in FIGS. 2 and 6, from the series of flaps as shown along each side edge of the carton blank as shown in FIG. 5, they fully position the roll ends within confinement for rotation with respect to the side walls, and in addition furnish structural support there under for the heavy weight of the film material embraced by the said roll.

Various locking tabs, as at 31, are provided along one side edge of the positioning flaps 28, and these tabs 31 are disposed for engaging within the formed slots 32 provided through the bottom of the bottom panel 2, so as to insure the erection and retention of these positioning flaps 28 beneath the located film roll. In addition, a locking tab 33 is formed between the folded positioning panels 20 and 21, when they are folded over as previously described, this particular locking tab 33 inserts within the slot 34, formed at the juncture of the foldable connection between the first flap 17, and the positioning flap 28. As can be seen, the slot 34 becomes arranged downwardly in position within the folded side wall of the carton, and the locking tab 33 likewise is disposed in a downward position when the positioning flaps 20 and 21 are arranged into their proper disposition within the folded side wall 16 of the formed carton. This can be seen in FIGS. 2 and 6 of the drawings that depict the arrangement of these various flaps, locking tabs, and slots within the formed and configured container.

Figure 4:
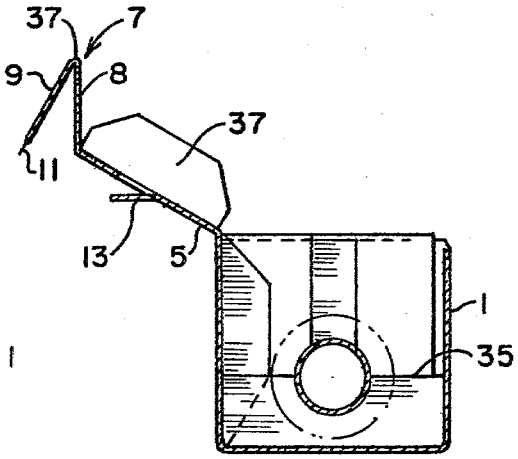
FIG. 4 discloses a vertical sectional view taken along the line 4—4 of FIG. 2.

As can be seen in FIG. 4, and as previously explained, the front flap 7 is folded over on its score line 10 into a double flap configuration forming the flaps 8 and 9, with the leading edge of the flap 9 having the cutter means 11 stapled or otherwise secured thereto. In the folded configuration, as shown, when the top panel 5 is folded into closure, upon the top of the carton, the flaps 8 and 9 come into contiguity and are inserted downwardly just interiorly of the front panel 1 of the carton, and come to rest contiguously against said panels inner surface. And, so as to prevent the too far inwardly insertion of these folded panels 8 and 9 within the carton, which would have a tendency to retract the cutter 11 within said carton, the positioning panels 20 and 21 are formed having stepped shoulders 35 and 36 in a position as shown, so that when these positioning panels 20 and 21 are folded over into the arrangement as previously described, their shoulders 35 and 36 come into alignment and are disposed upwardly, in the manner as shown in FIG. 4, so as to furnish a stop against which the leading edge, as at 37, of the folded panels 8 and 9 come to rest to preclude and limit the extent of insertion of the front panel 7 within the carton, as during usage. In addition, when it is desired to eliminate the cutting means 11 from its position of usage, the folded flaps 8 and 9 are unfolded from each other, and into a planar configuration, and then are inserted downwardly into the carton just inwardly of the front panel 1, so as to conceal the cutter within the lower reaches of the interior of the carton A. To provide clearance for the insertion of the cutter downwardly within the carton, as explained, it is to be noted from FIG. 5 that the folding flap 9 is narrower in dimension than its mating folding flap 8, and therefore the flap 9 clears the formed shoulders 35 and 36 arranged adjacent the side walls of the formed container.

As can also be seen, side flaps 37 are formed laterally of the top panel 5, and also conveniently fold within the interior of the side walls 16 of the container when it is folded into closure, so as to insure a full closing of the carton after its formation.

Various modifications to the carton of this invention may occur to those skilled in the art upon reviewing the subject matter of this invention. Such modifications, if within the spirit of this invention, and encompassed by the appended claims, are intended to be protected by any United States patent issuing upon this invention. The description of the preferred embodiment as just previously performed is set forth for illustrative purposes only.

Having thus described the invention what is claimed and desired to be secured by Letters Patent is:

1. A film material dispensing carton for supporting a roll of film, wrapping paper, or the like material and comprising front, back, and bottom panels foldably connected together, an openable top panel foldably connected to the back panel and providing closure at this location for the carton, said top panel having a slot therein for dispensing through unrolling of a quantity of the film material, side walls foldably connecting with one of said panels for providing side closure at each end of the said carton, a front flap foldably connecting with the forward edge of the top panel, a cutting means secured to the leading edge of the said front flap, said front flap having a fold line approximately at its midpoint and extending its full length, with the folding of the front flap along its fold line and its insertion contiguously against the inside of the front panel arranges the said cutting means into position for severing a segment of the unrolled film, each side wall including a first flap, said first flap being foldably connected to the back panel, a second flap foldably connected with the front panel and being arranged into adjacency with the said first flap, said second flap having an aperture therethrough for supporting the roll of film material at an end thereof, a pair of positioning flaps foldably connected together and also being foldably connected to an edge of the said first flap, each said pair of positioning flaps having an aligned aperture therethrough for assisting in support of the roll, a support flap foldably connecting with the opposite edge of the said first flap, said support flap having an aperture therethrough and being foldable in half and into adjacency with each other and against the said pair of positioning flaps for providing additional support to the proximate end of the material roll.

2. The invention of claim 1 and including a locking tab formed integrally with and extending from one edge of each support flap, a corresponding slot formed through the bottom panel, said tab being inserted into the said slot to lock the said side wall into position.

3. The invention of claim 1 and including a locking tab formed integrally of said pair of positioning flaps and at the juncture of their fold line, a slot formed at the juncture of the connection of the support flap with the said first flap, said positioning flaps tab inserting within the said slot to retain the said flaps erect.

4. The invention of claim 1 and wherein said side walls include stop means that limit the extent of insertion of the folded front flap into contiguity with the front panel, said stop means including a shoulder formed upon the frontal edge of the inwardmost positioning flap, whereby the folded front flap encounters the said positioning flap shoulder to limit the extent of insertion of the folded front flap to thereby fix its cutting means into a severing position just above the top panel.

5. The invention of claim 4 wherein said carton is formed from a unitary blank.

6. The invention of claim 1 wherein said carton is formed from a unitary blank.

* * * * *